United States Patent [19]

Gold

[11] Patent Number: 4,595,105

[45] Date of Patent: Jun. 17, 1986

[54] INTERLOCKING BOOKRACK

[76] Inventor: Kenneth S. Gold, 7721 Nevada Ave., Canoga Park, Calif. 91304

[21] Appl. No.: 649,740

[22] Filed: Sep. 12, 1984

[51] Int. Cl.[4] ..... A47B 65/00

[52] U.S. Cl. ..... 211/43; 211/184; 211/189; 108/60; 312/108; 312/263

[58] Field of Search ..... 211/43, 42, 11, 10, 211/189, 184; 312/108, 233, 263, 264; 108/60, 61

[56] References Cited

U.S. PATENT DOCUMENTS

| | | | |
|---|---|---|---|
| 1,030,279 | 6/1912 | Browne | 312/108 |
| 3,295,902 | 1/1967 | Doutt | 312/108 |
| 3,410,441 | 11/1968 | Rhyne | 312/263 X |
| 3,517,623 | 6/1970 | Goldstein et al. | 108/60 X |
| 4,178,047 | 12/1979 | Welch | 108/60 X |
| 4,378,137 | 3/1983 | Gibson et al. | 312/108 X |
| 4,395,955 | 8/1983 | Pfeifer | 211/184 X |

FOREIGN PATENT DOCUMENTS

| | | | |
|---|---|---|---|
| 1363227 | 5/1964 | France | 312/108 |
| 2092884 | 8/1982 | United Kingdom | 312/107.5 |

*Primary Examiner*—Ramon S. Britts
*Assistant Examiner*—B. M. Johnson
*Attorney, Agent, or Firm*—J. E. McTaggart

[57] ABSTRACT

For supporting hard- and soft-covered books, magazines, catalogs and other reading material of various sizes and shapes in an upright position on a bookshelf, table or desktop, this bookrack may be stored or shipped in knocked-down form, easily assembled without need for tools or fastening hardware. Sheet metal divider plates are held parallel to each other by sheet metal bottom and rear spacers, attached to the dividers by concealed fastenings, the bottom spacers being held in place by the rear spacers, which are in turn held in place by gravity and friction, holding the bookrack together in an interlocked assembly. The bookrack may be easily retrofitted into an existing bookcase without need for tools, fastening hardware or modifications to the bookcase. Spacers, available in different widths, may be tandemed together to build up the bookrack to any desired total width.

6 Claims, 5 Drawing Figures

INTERLOCKING BOOKRACK

BACKGROUND OF THE INVENTION

1. Field of the Invention

This invention relates to bookracks for supporting various hard- and soft-cover books, magazines, catalogs and the like in a vertical position. In particular, this invention relates to bookracks which may be easily assembled from knocked-down kits, and which are suitable for bookshelf or desktop locations.

2. Description of the Prior Art

Holding books upright has been a universal problem for many years, and has been addressed by numerous different bookrack configurations. Some, developed for public facilities such as libraries, required permanent installation as part of the original bookcase structure. Bookracks employing wires or rods as dividers were useful for hard-cover books but failed to adequately support magazines, catalogs, and other such soft-cover reading materials which have become increasingly prevalent. Sheet metal dividers, which are more satisfactory for soft booklets, have been available heretofore only in bulky, pre-assembled bookracks, inflexible in their total width and divider spacings and thus difficult or impossible to adapt to an existing bookshelf. Furthermore, known bookrack configurations have required considerable skill and use of tools to assemble and install, and even if adaptable to existing bookshelves, they may require drilled holes, screw holes or other irreversable and unacceptable modifications to be made to the bookshelf.

This evolution of modern reading materials has created a new and unfulfilled need for a bookrack which can be delivered in compact form to a user, easily assembled without tools, and, if desired, easily retrofitted by the user into an existing bookshelf without alterations, providing selectively spaced sheet metal dividers, capable of properly supporting a variety of hard- and soft-cover reading materials.

SUMMARY OF THE INVENTION

The present invention overcomes the aforementioned and other shortcomings by providing a bookrack in easily-assembled kit form, readily installed into an existing bookcase without alterations or tools, yet also suitable for standing alone. A novel fastening system eliminates any use of conventional fastenings such as screws, bolts or nails in the assembly of the bookrack and its installation in a bookshelf.

The bookrack of the present invention provides superior support to various hard- and soft-cover reading materials by utilizing sheet metal dividers positioned by spacers of selectable width, built up in tandem to any desired total width to fit an existing bookshelf. Fastening means along the sides of the bottom and rear spacers mate with corresponding fastening means along the bottom and rear edges of the dividers forming an interlocked assembly, easily assembled or disassembled without tools. The thin gauge metal bottom and rear spacers nest neatly against the shelf and back panel of a bookshelf with no need for fastenings or alterations.

The required book support is provided without impairing the normal operation or capacity of the bookshelf.

Small books may be placed toward the front of the bookrack for easy access, without loss of support. The thin gauge of the metal bottom spacer allows large books to extend forward beyond the bottom spacer, to rest on the bookshelf for secure support.

DESCRIPTION OF THE PREFERRED EMBODIMENT

Figure 1:
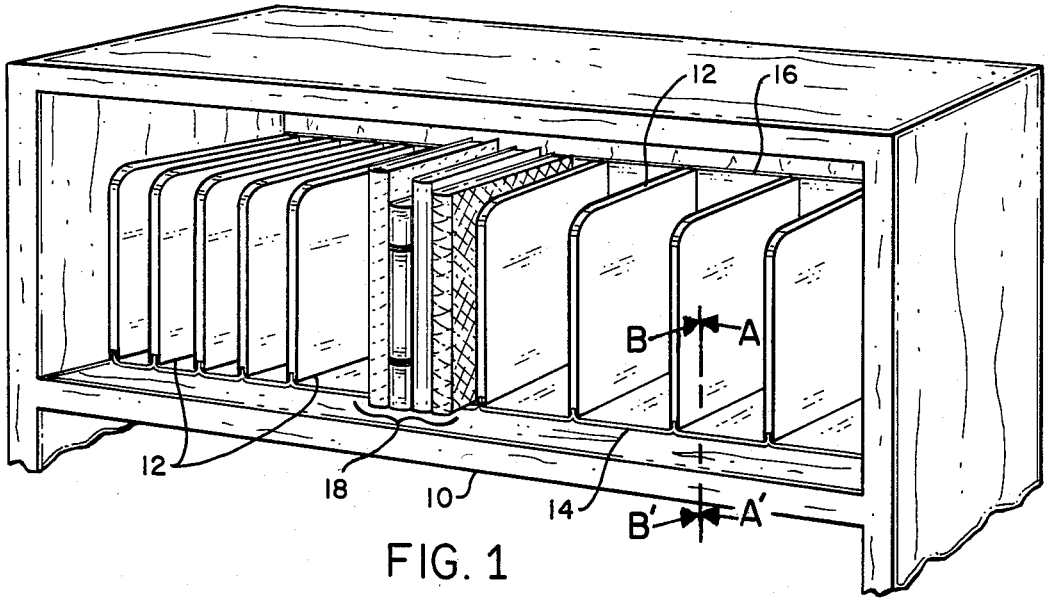
FIG. 1 is a perspective view of a bookrack embodying the teachings of this invention, placed into an existing bookcase.

Referring to the drawings, FIG. 1 illustrates a bookrack fabricated in accordance with this invention as it might be placed into an existing bookshelf 10. Dividers 12 are spaced parallel to each other by a bottom spacer 14 and a rear spacer 16 between each pair of dividers. A group of books 18 is shown supported in one of the compartments so formed. A series of such compartments may be built up to whatever total width is required by the size of the bookshelf 10.

Figure 2:
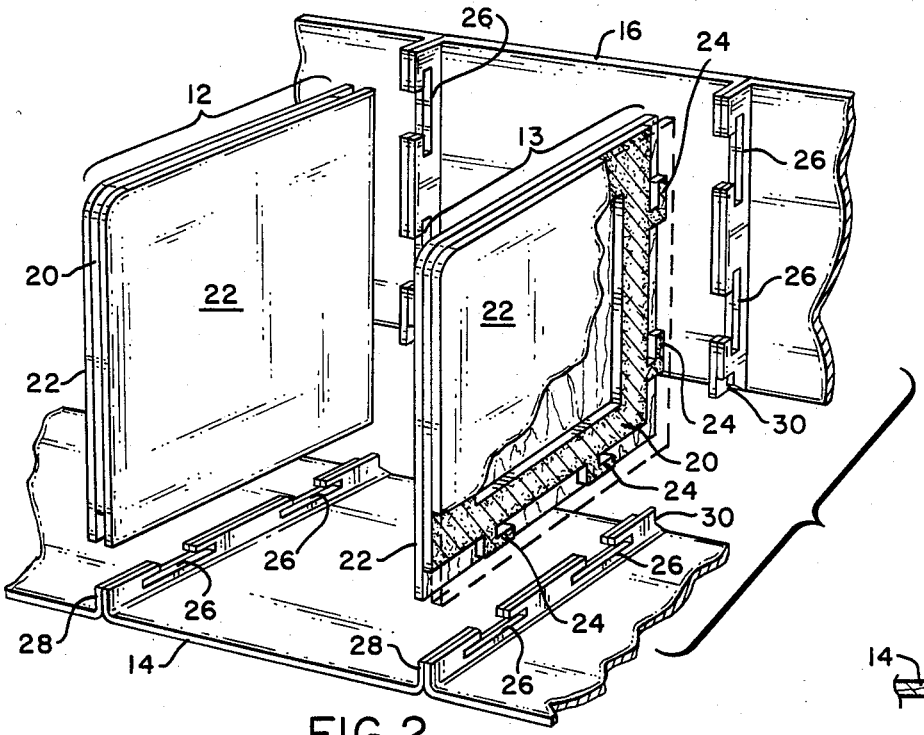
FIG. 2 is a partially exploded view of a section of the bookrack of FIG. 1 showing the configuration of a typical divider, rear spacer and bottom spacer.
Figure 4:
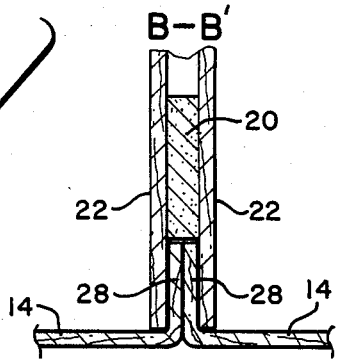
FIG. 4 shows Section B–B′ of FIG. 1; the lower portion of a divider straddling a pair of flanges of adjacent spacers.
Figure 3:
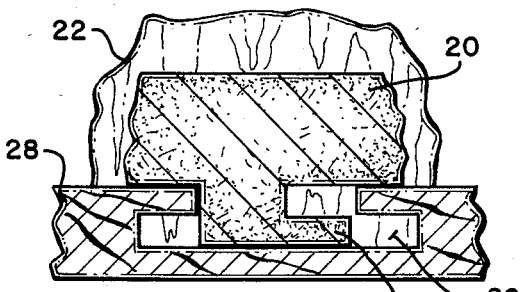
FIG. 3 shows a divider tab and a bottom or rear spacer flange cutout (a) in a semi-engaged position and (b) in the fully-engaged position Section A—A′ of FIG. 1.
Figure 3:
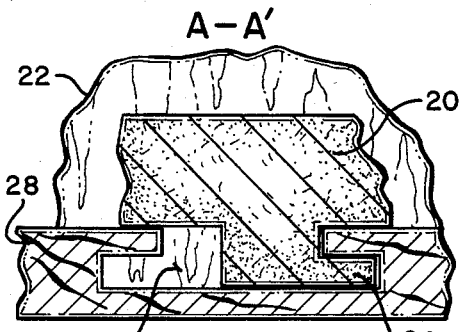

In the partially exploded view of FIG. 1, it is seen that bottom spacer 14 and rear spacer 16 are provided with flanges 28 at each side, while divider 12 is seen to be laminated from three flat sheets of metal, which are spot-welded together: a core piece 20, sandwiched between a pair of identical cover plates 22. It should be noted that all three pieces all in alignment along their front and top edges, but at the bottom and rear edges, the core piece 20 is shortened and provided with four L-shaped tabs 24: two on the bottom edge and two on the rear edge, as shown. Corresponding with three tabs, flanges 28 are equipped with T-shaped cutouts 26 which allow a divider 12 to be lowered onto a pair of abutting flanges 28 on bottom spacers 14, with the lower edges of cover plates 22 straddling the pair of flanges 28 as shown in FIG. 4. As seen in FIG. 3(*a*), the cutouts 26 have an upward-facing opening large enough to accept the foot of an L-shaped tab 24. These tabs 24 are concealed within the bottom region of dividers 12: in FIG. 2, the cover plate 22 of divider 13 at the right hand side of FIG. 2 is shown cut away from the central area of core piece 20, leaving a hollow region within the divider 12 for weight reduction; optionally, core piece 20 could be made without this hollow region.

For assembly, a divider 12 is first pushed down onto a pair of flanges 28, causing the bottom tabs 24 to assume the position within the flange cutout 26 shown in FIG. 3(*a*). The the divider 12 may be pushed backward until the tab 24 and cutout 26 become fully engaged as shown in FIG. 3(*b*). In this position, the rear edge of the bottom spacer 14 is made to align with the rear edge of the divider 12. Similarly, a pair of rear spacers 16 may be assembled against the rear of a divider 12, and the rear spacers 16 pushed downward until the rear tabs 24 and cutouts 26 become fully engaged as shown in FIG. 3(*b*). In this position, the rear edges 30 of the side flanges 28, shown in FIG. 2 on the bottom spacers 14, become constrained by the lower edges 30 of the side flanges 28 on the rear spacers 16. The further action of gravity in addition to friction holding the rear spacers 16 downward in their fully engaged position, ensures that the entire assembly will remain interlocked together in service, yet ready to easily disassemble whenever required, by simply performing the above-described assembly procedure in reverse order.

In the cross-sectional view shown in FIG. 4, a pair of flanges 20 of adjacent bottom spacers 14 are shown straddled by the lower edges of divider cover plates 22, which are separated by core piece 20.

In the preferred embodiment, the divider cover pieces 22 are made from 0.015" sheet metal, while the bottom and rear spacers 14 and 16 are made from 0.0125" sheet metal. The thickness of the divider core pieces 22 is made appoximately 0.04", chosen to allow for the thickness of a pair of spacer flanges including finishing material such as paint or plastic, to provide an optimal degree of friction for assembly. The dividers 12 are made approximately 8" by 8", the spacers being made available in a number of different widths, for example in multiples of ½", to provide flexibility in building up to a desired total bookrack width.

The inverted T shape of the openings 26 in spacer flanges 28 as shown in FIG. 3 has been chosen to enable bottom spacers 14 to be configured identical with corresponding rear spacers 16, for manufacturing economy. Alternatively, the spacer flange opening 26 could be made L-shaped, but that would require bottom spacers 14 to be configured different from rear spacers 16 with respect to the orientation of the openings 26.

The rear end edges 30 of bottom spacer side flanges 28 and the lower end edges 30 of rear spacer side flanges 28, in the preferred embodiment, are configured with a partial chamfer and a step, as shown in FIG. 2, the step being reversed on the left hand side compared to the right hand side so as to provide a complementary mating fit between each rear end edge of bottom spacer side flanges and each corresponding lower end edge of rear spacer side flanges. Alternatively, there are numerous other flange end configurations such as a simple chamfer or staircase pattern, capable of providing the desired functional complementary mating fit between rear and bottom spacer side flange ends.

These and other modifications, variations and adaptations which may become apparent to those of skill in the art are intended to be included within the scope and intent of the basic principles and spirit of this invention.

What is claimed is:

1. A collapsible bookrack, for adding onto an existing bookshelf, comprising:

a plurality of rectangular bottom spacers, each having (1) a front edge, (2) a rear edge, (3) two opposed side edges, and (4) bottom fastening means disposed along each of the side edges; said bottom spacers being disposed horizontally side by side, a plurality of identical flat dividers each disposed vertically above abutting side edges of an adjacent pair of said bottom spacers, each of said dividers having (1) a top edge, (2) a front edge, (3) a bottom edge, (4) divider/bottom-fastening means, disposed along the bottom edge, configured to engage the bottom-fastening means, whereby abutting side edges of an adjacent pair of said bottom spacers may be removably fastened to the bottom edge of a corresponding one of said dividers, (5) a rear edge, and (6) divider/rear-fastening means disposed along the rear edge, and a plurality of rear spacers each having (1) a top edge, (2) a bottom edge, (3) two opposed side edges, and (4) disposed along each of the side edges, rear-fastening means configured to engage the divider/-rear-fastening means of said dividers whereby abutting side edges of each adjacent pair of said rear spacers may be removably fastened to the rear edge of a corresponding one of said dividers; said rear spacers being disposed vertically side by side, each located above but not directly fastened to the rear edge of a corresponding one of said bottom spacers, the divider/bottom-fastening means of each of said dividers being contained within a cavity along the bottom edge of the divider and the divider/rear-fastening means being contained within a cavity located along the rear edge of the divider, such that assembly of said bottom spacers requires the bottom-fastening means to be inserted into the cavities in the bottom edges of said dividers to a semi-engaged position from which the dividers must be shifted forward to a fully-engaged position, and assembly of said rear spacers together with said dividers requires the rear-fastening means to be inserted into the cavities in the rear edges of said dividers to a semi-engaged position from which the rear spacers must be shifted downward to a fully-engaged position; whereby, when the bookrack is assembled, all of the fastening means become fully enclosed, and all of said dividers and spacers present completely smooth surfaces with no protrusions inside or outside the bookrack, thus enabling the bookrack to nest unobtusively and space-efficiently into an existing bookshelf to provide the capability of supporting soft-cover booklets and the like effectively in an upright position.

2. The invention as defined in claim 1 wherein the process of assembling said bottom spacers, said dividers and said rear spacers of the bookrack together comprises the steps of (a) placing a plurality of said bottom spacers horizontally side by side, (b) placing a plurality of said dividers vertically above corresponding abutting side edges of said bottom spacers, (c) moving said dividers downward into a semi-engaged position, (d) shifting said dividers rearward relative to said bottom spacers, into a fully-engaged position, (e) placing abutting adjacent side edges of a plurality of said rear spacers against rear edges of said dividers, (f) moving said rear spacers forward into a semi-engaged position, and (g) shifting said rear spacers downward relative to said dividers into a fully-engaged position wherein said rear spacers, being held in their engaged position together with said dividers partially by gravity and partially by friction between the divider/rear-fastening means and the rear-fastening means, are made to assume a position which blocks rearward movement of said bottom spacers relative to said dividers, thus locking said bottom spacers and said dividers together in their engaged positions without need for additional fastenings such as screws, bolts or rivets.

3. The invention as defined in claim 2 wherein each of said dividers comprises a core piece sandwiched between a pair of identical cover plates, each cover plate and core piece having a front edge, a top edge, a rear edge and a bottom edge, the front edge of each cover plate being aligned with the front edge of the sandwiched core piece, the top edge of each cover plate being aligned with the top edge of the sandwiched core piece, the bottom edge of the core piece being provided with divider/bottom-fastening means, the bottom edge of each cover plate extending beyond the bottom edge of said core piece so as to enclose the divider/bottom-fastening means, and the rear edge of said core piece being provided with divider/rear-fastening means, the rear edge of each cover plate extending rearward beyond the rear edge of said core piece so as to enclose the divider/rear-fastening means.

4. The invention as defined in claim 3 wherein:

said bottom-fastening means comprise upwardly-facing flanges, one along each of the two sides of each said bottom spacers, the flanges being provided with a plurality of cutout openings in the shape of an inverted letter T, said divider/bottom-fastening means comprise, along the bottom edge of each of said divider core pieces, a plurality of L-shaped tabs configured to removably engage corresponding ones of the cutout openings in the flanges along the side edges of said bottom spacers, said rear-fastening means comprise forward-facing flanges, one along each of the two side edges of each of said rear spacers, the flanges being provided with a plurality of cutout openings in the shape of a letter T turned on its side, and said divider/rear-fastening means comprise, at the rear edge of each of said divider core pieces, a plurality of L-shaped tabs configured to removably engage corresponding ones of the cutout openings in the flanges along the side edges of said rear spacers.

5. The invention as defined in claim 4 wherein each of said bottom spacers, being positioned in front of a corresponding one of said rear spacers, is made to be identical in configuration with its corresponding rear spacer.

6. The invention as defined in claim 5 wherein said bottom spacers and said rear spacers are provided in a selection of different widths, whereby a bookrack constructed in accordance with this invention may be customized to provide a desired quantity of said dividers, spaced apart as desired, and to occupy a specified total width to fit available space in an existing bookshelf.

* * * * *